US008881846B2

(12) United States Patent
Sitka

(10) Patent No.: US 8,881,846 B2
(45) Date of Patent: Nov. 11, 2014

(54) DIRECTIONAL DRILLING CONTROL USING A BENDABLE DRIVESHAFT

(71) Applicant: Halliburton Energy Services, Inc., Houston, TX (US)

(72) Inventor: Mark A. Sitka, Richmond, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/006,510

(22) PCT Filed: Dec. 21, 2012

(86) PCT No.: PCT/US2012/071235

§ 371 (c)(1),
(2), (4) Date: Sep. 20, 2013

(87) PCT Pub. No.: WO2014/098892

PCT Pub. Date: Jun. 26, 2014

(65) Prior Publication Data

US 2014/0174831 A1 Jun. 26, 2014

(51) Int. Cl.
*E21B 7/06* (2006.01)
*E21B 7/08* (2006.01)

(52) U.S. Cl.
CPC . *E21B 7/06* (2013.01); *E21B 7/067* (2013.01); *E21B 7/062* (2013.01)
USPC ..... 175/61; 175/73; 285/118

(58) Field of Classification Search
CPC ..... E21B 7/062; E21B 7/067; E21B 7/068
USPC ..... 175/61, 62, 75, 256, 73; 285/118
See application file for complete search history.

(56) References Cited

U.S. PATENT DOCUMENTS

| | | | | | |
|---|---|---|---|---|---|
| 4,597,454 | A | * | 7/1986 | Schoeffler | 175/61 |
| 4,733,603 | A | * | 3/1988 | Kukolj | 92/92 |
| 4,957,173 | A | | 9/1990 | Kinnan | |
| 5,439,064 | A | * | 8/1995 | Patton | 175/24 |
| 6,158,529 | A | * | 12/2000 | Dorel | 175/61 |
| 6,427,783 | B2 | | 8/2002 | Krueger et al. | |

(Continued)

FOREIGN PATENT DOCUMENTS

| | | | |
|---|---|---|---|
| FR | 2817904 | A1 | 6/2002 |
| GB | 2172325 | A | 9/1986 |
| WO | 0061916 | A1 | 10/2000 |
| WO | 2014098892 | A1 | 6/2014 |

OTHER PUBLICATIONS

Dictionary definitions of "bend" and "deflect", accessed Apr. 4, 2014 via thefreedictionary.com.*

(Continued)

*Primary Examiner* — Blake Michener
(74) *Attorney, Agent, or Firm* — McDermott Will & Emery LLP; Anthony Iannitelli

(57) ABSTRACT

Disclosed are systems and methods of directional drilling with a steering sub. One steering sub includes a housing defining a central passage, a shaft extended within the central passage, bearings arranged within the central passage and configured to receive and support the shaft for rotation within the central passage, and one or more pressure chambers defined longitudinally in the housing and configured to deflect the housing upon experiencing an increased pressure, wherein deflection of the housing causes the shaft to correspondingly deflect via engagement with the bearings.

24 Claims, 4 Drawing Sheets

(56) References Cited

U.S. PATENT DOCUMENTS

| | | | | |
|---|---|---|---|---|
| 6,470,974 | B1 * | 10/2002 | Moore et al. | 175/45 |
| 6,626,254 | B1 * | 9/2003 | Krueger et al. | 175/61 |
| 7,810,585 | B2 * | 10/2010 | Downton | 175/73 |
| 8,011,448 | B2 | 9/2011 | Tulloch et al. | |
| 8,464,811 | B2 * | 6/2013 | Shepherd | 175/73 |
| 2001/0011591 | A1 * | 8/2001 | Van-Drentham Susman et al. | 166/298 |
| 2001/0052428 | A1 | 12/2001 | Larronde et al. | |
| 2003/0051919 | A1 * | 3/2003 | Moore et al. | 175/73 |
| 2004/0016571 | A1 * | 1/2004 | Krueger | 175/61 |
| 2006/0157281 | A1 | 7/2006 | Downton | |
| 2006/0254825 | A1 * | 11/2006 | Krueger et al. | 175/61 |
| 2011/0031023 | A1 | 2/2011 | Menezes et al. | |
| 2011/0120775 | A1 | 5/2011 | Krueger et al. | |
| 2011/0240368 | A1 | 10/2011 | Allen et al. | |

OTHER PUBLICATIONS

Dictionary definitions of "chamber"; "cross-section"; "Newton's Laws of Motion"; "Pascal's Law"; "pressure"; "volume"; accessed Jun. 18, 2014 via thefreedictionary.com.*

International Search Report and Written Opinion for PCT/US2012/071235 dated Aug. 5, 2013.

* cited by examiner section B-B of FIG. 3A

DIRECTIONAL DRILLING CONTROL USING A BENDABLE DRIVESHAFT

This application is a national stage entry claiming priority to International Application No. PCT/US2012/71235, filed on Dec. 21, 2012.

BACKGROUND

This disclosure describes a system and method directed toward directional drilling of a subterranean well and, in particular, controlling the angle and direction of drilling through selectable bending of a shaft within a steering sub connected to the drill bit.

In some conventional drilling operations, a mud motor is used to rotate the drill bit with respect to the drill string. A typical mud motor is a positive displacement motor that is driven by the flow of drilling fluid, commonly known as "mud," that is pumped down from the surface through the mud motor and then to the drill bit, where the drilling fluid flows into the borehole through jets in the drill bit. The drilling fluid flushes rock cuttings and debris from the cutting face of the drill bit and carries them to the surface.

It is sometimes desirable to directionally drill at an angle or even horizontally away from a vertical line that is directly underneath a drilling rig. One conventional method of directional drilling is to provide a small bend angle above the mud motor and the bearing assembly that supports the drill bit. If the drill string is rotated from the surface while drilling, the drill bit creates a straight, slightly oversized borehole. In the absence of surface drill string rotation and only rotation from the mud motor, however, the drill bit will advance in the direction of the bend and create a borehole that curves away from the vertical axis in the direction of the bend.

One drawback of the conventional method of directional drilling is that the rotational position of the lower end of a long drill string may not be precisely known due to elastic rotational deformation of the drill string between the surface and the mud motor. This uncertainty may result in the drill bit progressing in a lateral direction other than the intended direction, requiring an adjustment in the rotational position of the drill string to attempt to steer the drill bit back toward the intended direction.

An additional drawback of the conventional method of directional drilling is that the speed of drilling the straight portions of the borehole, which may form the majority of the length of a typical borehole, with a drill string having a bent sub is reduced compared to drilling with a drill string not having a bent sub because the borehole must be larger in diameter due to the necessary rotation of the drill string to maintain a straight drill path with the angled drill bit.

SUMMARY OF THE DISCLOSURE

This disclosure describes a system and method directed toward directional drilling of a subterranean well and, in particular, controlling the angle and direction of drilling through selectable bending of a shaft within a steering sub connected to the drill bit.

In certain embodiments, an apparatus is disclosed that includes a housing defining a central passage, a shaft extended within the central passage, bearings arranged within the central passage and configured to receive and support the shaft for rotation within the central passage, and one or more pressure chambers defined longitudinally in the housing and configured to deflect the housing in response to experiencing an increased pressure. Deflection of the housing causes the shaft to correspondingly deflect via engagement with the bearings.

In certain embodiments, a system is disclosed that includes a drill string, a drill bit arranged at a distal end of the drill string, and a steering apparatus coupled between the drill string and the drill bit and configured to direct the drill bit. The steering apparatus has a housing defining a central passage, a shaft extended within the central passage, bearings arranged within the central passage and configured to receive and support the shaft for rotation within the central passage, and one or more pressure chambers defined longitudinally in the housing and configured to deflect the housing upon experiencing an increased pressure. Deflection of the housing causes the shaft to correspondingly deflect via engagement with the bearings.

In certain embodiments, a method of steering a drill bit is disclosed. The method includes the step of supporting a shaft for rotation within a housing of a steering hub with one or more bearings arranged within the housing and interposing the shaft and the housing. The shaft is operatively coupled to the drill bit. The method also includes the steps of pressurizing one or more pressure chambers defined longitudinally within the housing and thereby causing the housing to deflect and deflecting the shaft via engagement with the one or more bearings which transfer lateral deflection forces from the housing to the shaft.

In certain embodiments, an adjustable bend sub is disclosed that includes a housing having first and second ends configured to be fixedly coupled to first and second elements, respectively, of a drill string, and one or more pressure chambers defined longitudinally in the housing and configured to deflect the housing upon experiencing an increased pressure.

The features of the present disclosure will be readily apparent to those skilled in the art upon a reading of the description of the preferred embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

This disclosure describes a system and method directed toward directional drilling of a subterranean well and, in particular, controlling the angle and direction of drilling through selectable bending of a shaft within a steering sub connected to the drill bit.

The use of the exemplary steering subs disclosed herein provides several features that may be distinguishing over a conventional drill string having a bent sub. A first feature is that the drill bit may be guided to drill in any direction without requiring that the drill string be rotated from the surface to a particular angular position, thus simplifying operation of the drilling rig. Additionally, the drill bit may be positioned to drill at a selectable angle within a range of angles, rather than the fixed angle provided by a conventional bent sub, thereby providing additional control over the path of the borehole.

Another aspect of the disclosed systems and methods is that the vertical borehole may be smaller, compared to a borehole drilled using a conventional bent sub. When needed, the steering subs disclosed herein may be configured to align the drill bit with the drill string centerline, thereby allowing the drill bit to advance directly downward without a requirement to rotate the drill string to maintain straight-line motion. Given the reduced amount of material to be removed for a smaller-diameter borehole, the drill bit may be able to advance faster.

Within this disclosure, the phrase "mud motor" refers not only to the specific power-generating devices that are commonly referred to by that name, but may also include all other systems and methods of providing the rotational power to drive a drill bit at the lower end of a drill string. This includes, by way of example and not as a limitation, other types of motors driven by electricity or hydraulic fluid that are located along the drill string as well as power provided from the surface through a rotating shaft.

Within this disclosure, the phrase "drill pipe" refers to all types and kinds of pipe, tubing, and tubulars used to connect between a drill rig on the surface and a subterranean system within a borehole.

Figure 1:
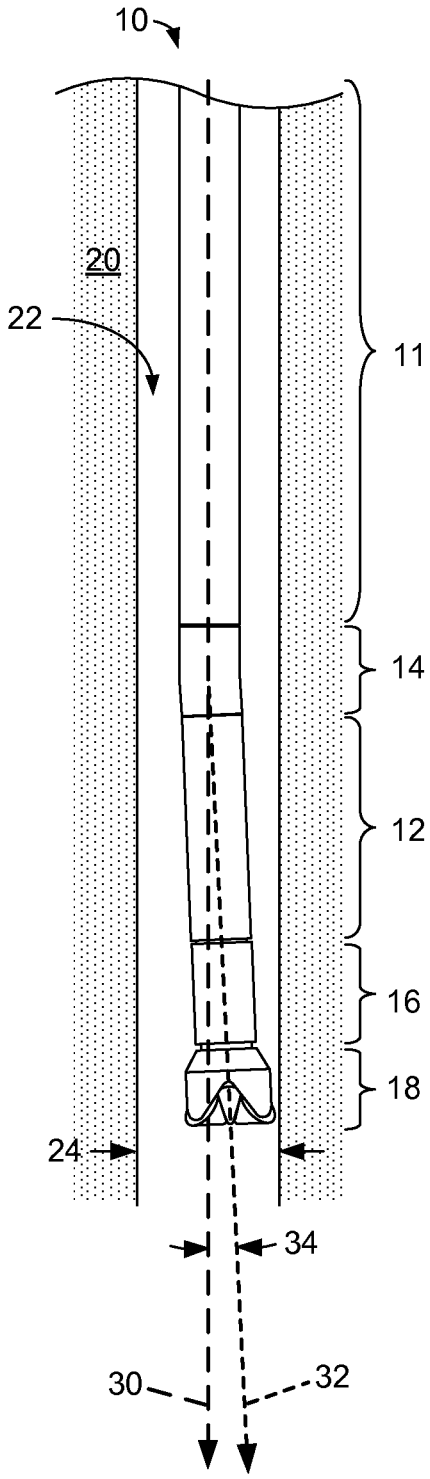
FIG. 1 PRIOR ART
FIG. 1 depicts a conventional drill string for drilling an angled borehole.

FIG. 1 depicts a conventional drill string 10 for drilling an angled borehole 22. The drill string 10 consists of a string of connected drill pipe 11 that is connected, in this example, to the upper end of a power section, e.g. a mud motor 12. The mud motor 12 is connected to a bent sub 14 configured to create a fixed bend in the drill string 10 with an angle 34. In this example, a bearing assembly 16 is then attached to the lower end of the bent sub 14, with a drill bit assembly 18 attached to the lower end of the bearing assembly 16.

Still referring to FIG. 1, the straight, vertical borehole 22 is created by rotating the drill string 10 as the drill bit 18 advances through the subterranean formation 20, thereby advancing the drill string 10 along the axis 30, cutting a borehole with a diameter 24. If the surface rotation of the drill string 10 is stopped in the position shown in FIG. 1 while the drill bit 18 continues to cut due to rotation generated by mud motor, the drill string 10 will advance along the new path 32, shown as a dashed-line arrow. The radial direction in which the drill string 10 will advance is controlled by the rotational position of the bent sub 14. As the bent sub 14 is rotationally positioned by rotating the entire length of the drill pipe 11, which may total 20,000 feet or more, there may be some uncertainty in the rotational position of the bent sub 14 and therefore the radial direction of the path 32 along which the drill string 10 will advance.

Figure 2:
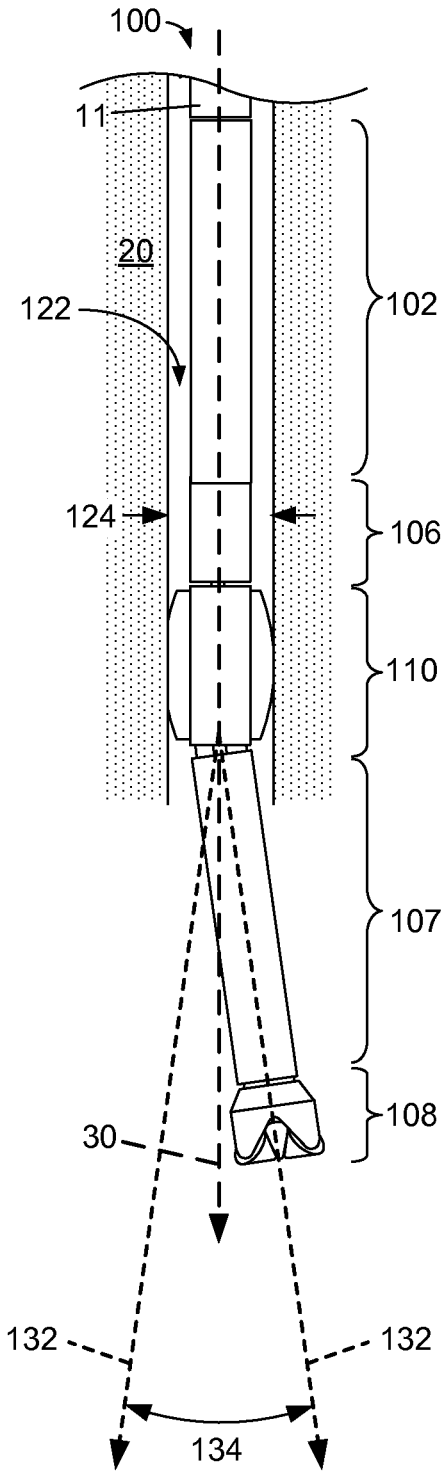
FIG. 2 depicts an exemplary drill string with a steering sub for drilling an angled borehole at a selectable angle and orientation according to certain aspects of the present disclosure.

FIG. 2 depicts an exemplary drill string 100 with a steering sub 110 for drilling an angled borehole 122 at a selectable angle and orientation according to certain aspects of the present disclosure. In this example, a mud motor 102 is attached to a lower end of a string of drill pipe 11. The steering sub 110 may be attached through a bearing assembly 106 to a lower end of the mud motor 102, with a drill bit 108 attached to a lower end of the steering sub 110. The construction of the steering sub 110 is discussed in greater detail with respect to FIGS. 3A-3C. In certain embodiments, the drill string 100 may include control lines (not shown in FIG. 2) extending from the surface to the steering sub 110. As the methods and arrangements for running control lines down boreholes to control subterranean equipment are generally known to those of skill in the art, these control lines are omitted from the figures in this disclosure for clarity. In certain embodiments, the steering sub 110 may receive control signals from a lower sub 107 that is coupled to a drill bit 108. Control signal commands may be defined by internal programming or otherwise may be received from the surface via mud telemetry communication.

While advancing directly downward, the steering sub 110 may be selectively adjusted to have a zero degree offset from the nominal vertical axis 30. The resulting borehole 122 has a diameter 124, which generally matches that of the drill bit 108, and smaller than the diameter 24 of the borehole 22 created by the conventional directional drill string 10. At a point where it is desired to start to drill in a lateral direction, or otherwise deviate from a straight borehole 22, the steering sub 110 may be actuated in order to reposition the drill bit 18 at an angle within the example limits shown by the dashed lines 132. In certain embodiments, the angular configuration of the steering sub 110 may be selected to have any value within the range 134 and, in certain embodiments, may be adjusted continuously as the drill string 100 advances, thus enabling operators to more accurately select the path of the borehole 122.

While the disclosed embodiment 100 is presented in terms of a rotary drill bit 18 being driven by a mud motor 102 or the like, those of skill in the art will recognize that the same concepts and designs may be applied to steer other types of drilling mechanisms, such as an arrangement of hydraulic jets.

Figure 3A:
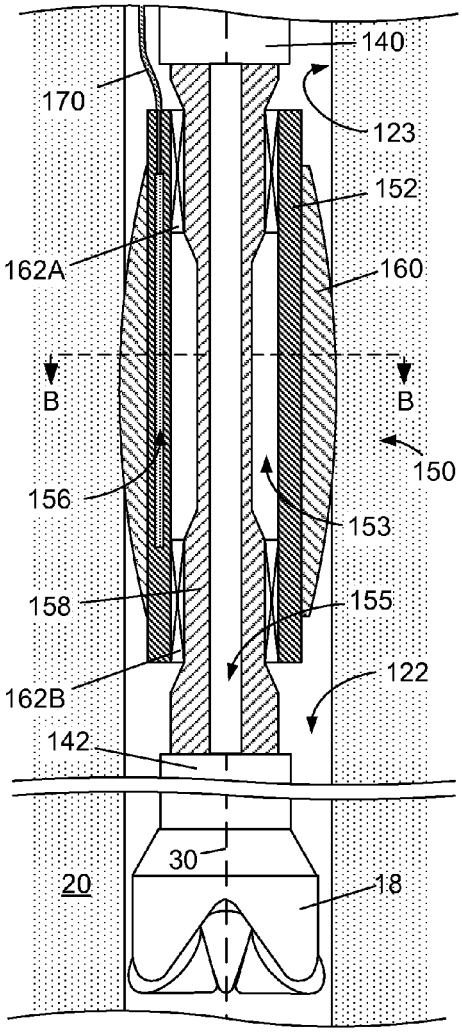
FIGS. 3A-3C are cross-sections of an example steering sub according to certain aspects of the present disclosure.
Figure 3C:
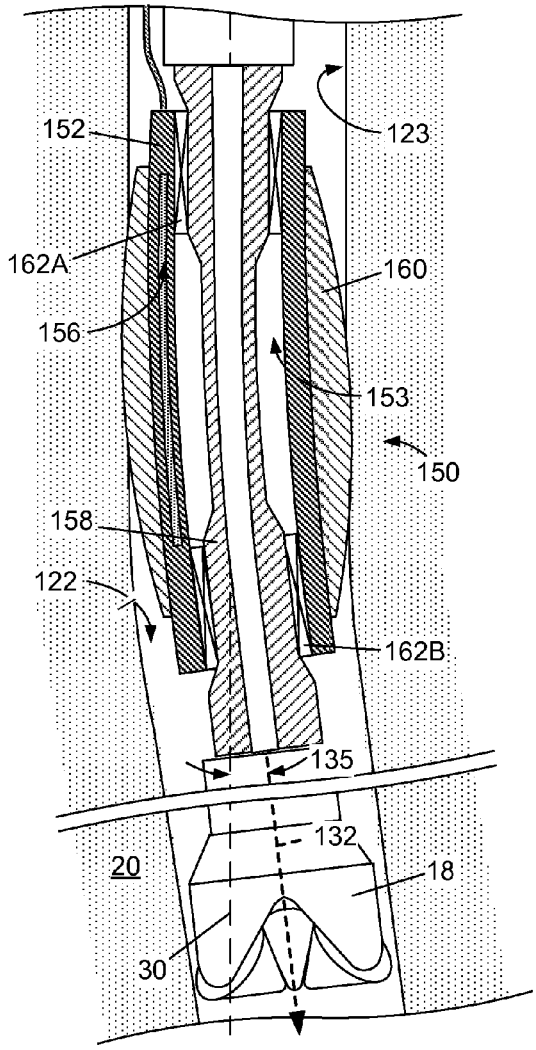
Figure 3B:
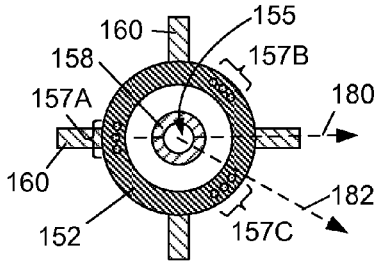

FIGS. 3A-3C are cross-sections of an example steering sub 150 according to certain aspects of the present disclosure. The steering sub 150 may be substantially similar to the steering sub 110 of FIG. 2. Referring to FIG. 3A, the steering sub 150 may include a housing 152 with an axis 30 passing through a center of the housing 152. A shaft 158 may pass through the central passage 153 of the housing 152 and, in this example, be attached to the string of drill pipe 140 at a top end thereof. The shaft 158 is shown in FIG. 3A in an undeformed or straight shape. In certain embodiments, the shaft 158 may be coupled at a bottom end thereof to the housing of a lower sub 142. In certain embodiments, a mud flow passage 155 passes through the shaft 158.

The lower sub 142 may include one or more instruments such as a Weight-On-Bit (WOB) sensor or a Torque-On-Bit (TOB) sensor. The lower sub 142 may also include a Measurement-While-Drilling (MWD) sensor package with one or more sensors configured to measure parameters such as pressure or temperature as well as accelerometers to determine the wellbore trajectory in three-dimensional space. The lower sub 142 may also include a Logging-While-Drilling (LWD) sensor package with one or more sensors configured to measure formation parameters such as resistivity, porosity, sonic propagation velocity, or gamma ray transmissibility. In certain embodiments, the steering sub 110 may be coupled to additional steering subs 150 or other steering tools.

In certain embodiments, the shaft 158 may be coupled to or otherwise form an integral part of another shaft (not visible in FIG. 3A) that passes through the lower sub 142 and is eventually coupled to the drill bit 18 located below a lower end of the lower sub 142. During operation, the housing of the lower sub 142 may or may not synchronously rotate with the drill bit 18.

Still referring to FIG. 3A, the housing 152 may include a plurality of pressure chambers 156 that are arranged longitudinally around the circumference of the housing 152. In the view of FIG. 3A, only a single pressure chamber 156 is visible. It should be noted that the number, length, arrangement, and orientation of the pressure chambers 156 may be varied from the configurations of the example embodiments, for example to provide more deflection and/or control, without departing from the scope of this disclosure.

In the example of FIGS. 3A-3C, the shaft 158 may be supported for rotation within the housing 152 by a pair of axially offset bearings 162A, 162B positioned at each end of the housing 152. As a result, the shaft 158 may be able to rotate while the housing 152 generally does not rotate with respect to the borehole 122. In certain embodiments, one or more of the bearings 162 may be replaced by another type of anti-friction device, for example a bronze bushing. The housing 152 is depicted in FIG. 3A as open-ended to simplify the explanation of the components. It will be apparent to those of skill in the art, however, that the housing 152 may have numerous additional features omitted for clarity including end caps, bearing mounts, seals, and external attachment points as required to locate and retain internal components and attach to external elements such as the string of drill pipe 140.

In the example of FIG. 3A, there are a plurality of centralizers or stabilizers 160 attached to an external surface of the housing 152 that extend outward from the housing 152 and are configured to engage the sidewall 123 of the borehole 122. In certain embodiments, the stabilizers 160 are configured to resist rotation of the housing 152 about axis 30 by friction with or partial embedment in the sidewall 123 of the borehole 122 and maintain the drill pipe 140 centralized therein. In certain embodiments, the external edges of the stabilizers 160 may be curved to allow a certain degree of rotation of the steering sub 150 about an axis that is perpendicular to the axis 30. In certain embodiments, the stabilizers 160 may have a retracted position wherein there is a clearance between one or more of the stabilizers 160 and the sidewall 123 and an extended position wherein the one or more stabilizers 160 engage the sidewall 123.

In certain embodiments, the plurality of pressure chambers 156 may be fluidly coupled to at least one control line 170 configured to convey pressurized hydraulic fluid to the pressure chambers 156. In at least one embodiment, the hydraulic fluid may be oil, water, or another type of hydraulic fluid. In certain embodiments, the steering sub 150 may include fluid conduit, valves, and other flow control devices known to those of skill in the art between the control line 170 and one or more pressure chambers 156 as suitable for providing fluid at a selected pressure to one or more of the pressure chambers 156. In certain embodiments, the steering sub 150 may include sensors known to those of skill in the art configured to detect, for example, the shape, position, and orientation of the shaft 158 and provide signals related to these parameters. In certain embodiments, the steering sub 150 may include sensors known to those of skill in the art configured to detect, for example, the pressure and temperature of the fluid within the pressure chambers 156 and provide signals related to these parameters. These control devices and sensors and other equipment known to those of skill in the art are omitted from the figures herein for clarity.

It should be noted that the steering sub 150 and drill string elements shown in FIGS. 3A-3C, as well as the other embodiments shown in the other figures, are schematic in nature and not particularly drawn to scale and therefore should not be considered limiting to the scope of the disclosure. Rather, the individual elements are sized and spaced so as to make clear their function and interrelation with other pertinent elements and, as such, may not reflect actual sizes or configurations. Moreover, certain components of the steering sub 150 and drill string elements that are known to those of skill in the art are omitted to avoid obscuration of the novel features of the disclosure.

FIG. 3B is a cross-sectional view taken of the entire steering sub 150 at the section line B-B shown in FIG. 3A. In this example, the housing 152 includes or otherwise defines three sets 157A, 157B, 157C, of pressure chambers, each having three pressure chambers 156. In certain embodiments, there may more or fewer than three sets of pressure chambers 156, without departing from the scope of the disclosure. Moreover, while three pressure chambers 156 are depicted in each set 157A-C, in other embodiments, more or less than three than three (e.g., including one) pressure chambers 156 may be included in some or all of each set 157A-C.

While depicted as circular or otherwise rounded profiles, in certain embodiments, the pressure chambers 156 may equally have a different shape or configuration, for example passages having rectangular profiles. In the non-limiting example of FIG. 3B, each set 157A, 157B, 157C has three pressure chambers 156 with the sets 157A, 157B, 157C arranged around the shaft 158 in a symmetric pattern. In other embodiments, however, the sets 157A, 157B, 157C may be arranged symmetrically or in other arrangements including providing radially offset layers of pressure chambers 156. In some embodiments, multiple layers of pressure chambers 156 may prove advantageous in providing redundancy in the event that a single pressure chamber 156 develops a leak or is otherwise rendered inoperable.

It can be seen in FIGS. 3A and 3B that there is a clearance between a central portion of the shaft 158 and the housing 152 such that forces are applied by the housing 152 to the shaft 158 only through the bearings 162A, 162B. In the absence of applied forces, the shaft 158 returns to its undeformed or straight shape, e.g. the straight shape shown in FIG. 3A.

FIG. 3C depicts the steering sub 150 while being operated to orient the drill bit 18 at an angle 135 from the nominal vertical axis 30. In this example, a fluid at a certain pressure has been provided into one or more of the pressure chambers 156 in the first set 157A through the control line 170, thereby causing the pressure chamber 156 to bend the housing 152, as further discussed in greater detail with respect to FIG. 4B. Increasing the pressure within a pressure chamber 156 generates a pressure differential that causes that particular pressure chamber 156 to bend or otherwise deflect, thereby exerting a longitudinal bending force on the housing 152 in which it is arranged. In response to the bending force supplied by the pressure chamber 156, the housing 152 may also tend to bend or deflect in response thereto, and such bending force may be transmitted to the shaft 158 via the bearings 162A,B. In other words, when the housing 152 bends, the bearings 162A,B may force the shaft 158 to correspondingly bend or deflect toward a deformed shape, e.g. the shape of the shaft 158 depicted in FIG. 3C. It will be appreciated that pressurizing more than one pressure chamber 156 in a particular set 157A-C, such as pressurizing all pressure chambers 156 of a particular set, may increase the longitudinal bending force applied by the housing 152 to the shaft 158, and thereby deflecting the shaft 158 more dramatically.

It should be noted that one or more pressure chambers 156 from multiple sets 157A, 157B, 157C can be simultaneously pressurized to bend the housing 150 (and thereby the shaft 158) in a selected direction. For example, pressurizing only the three pressure chambers 156 of set 157A may tend to bend the housing 150 in the direction indicated by arrow 180. In a second example wherein one or more of the pressure chambers 156 of set 157B are pressurized in addition to the set 157A, or provided with a different pressure than the set 157A, the housing 150 may tend to bend in a different direction indicated by the arrow 182. Accordingly, the shaft 158 may be bent in any direction by appropriate selection of which pressure chambers 156 are pressurized and to what degree.

It will be apparent to those of skill in the art that other configurations of pressure chambers and hydraulic housings may be employed to cause the shaft 158 to assume a deformed or bent shape similar to that caused by the disclosed apparatus. In certain embodiments, a pressure-activated mechanism, such as a hydraulic cylinder, may be provided as a separate element within or external to the housing 152. The embodiments disclosed herein are only examples of means of bending the housing 152 by a selected amount in a selected direction, thereby bending of shaft 158 in the same direction, and other means of bending the housing 152 may be employed without departing from the scope of this disclosure.

Figure 4A:
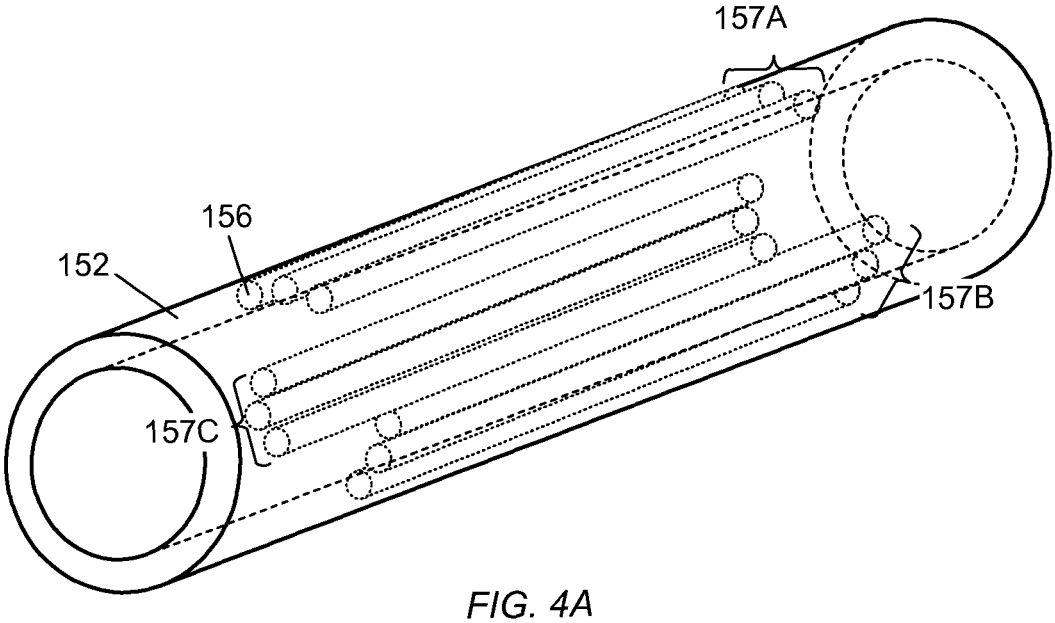
FIGS. 4A-4B depict the operation of an example hydraulic sleeve according to certain aspects of the present disclosure.
Figure 4B:
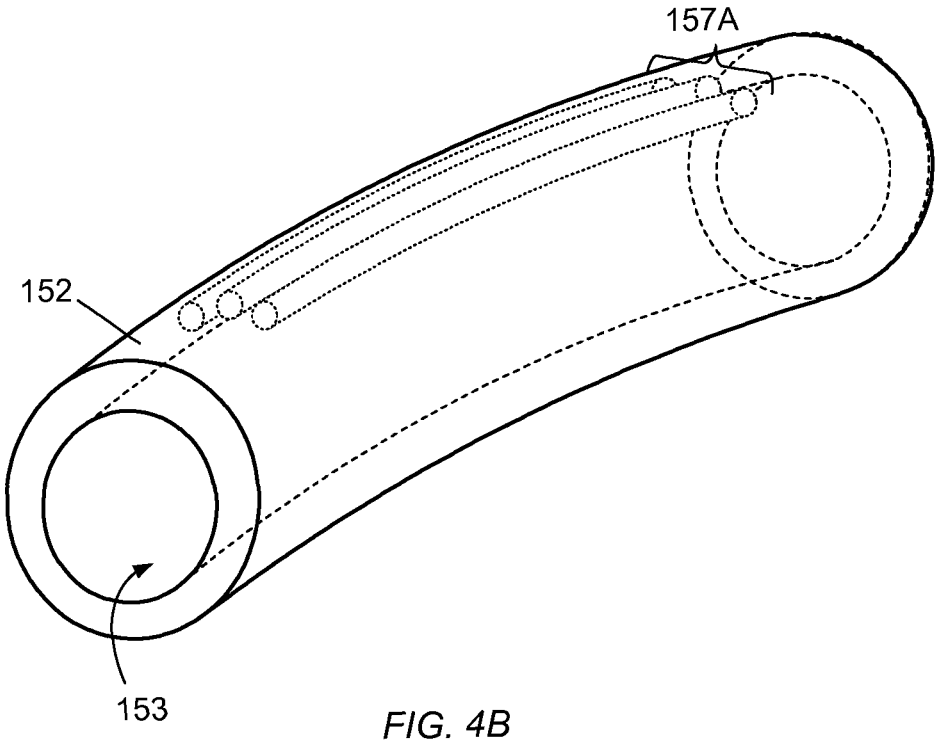

FIGS. 4A-4B depict the exemplary operation of an example deformable housing 152 according to certain aspects of the present disclosure. In this example, the three sets of pressure chambers 157A-C are evenly distributed around the circumference of the housing 152. FIG. 4A depicts the housing 152 in an undeformed or straight shape when the pressures in the three sets of pressure chambers 157A-C are approximately equal or otherwise none of the pressure chambers 156 are pressurized for bending the housing 152.

FIG. 4B depicts the deformed or bent shape of the housing 152 when one or more pressure chambers 156 in the first set 157A are pressurized while the sets 157B and 157C are essentially unpressurized. As illustrated, upon pressurizing one or more pressure chambers 156 in the first set 157A, the housing 152 tends to bend or otherwise deflect in an arcuate manner. As will be appreciated, a similar effect may occur when the pressure in the first set 157A is higher than the pressures in the second and/or third sets 157B and 157C; e.g., when there is a biasing pressure applied equally to all of the sets of pressure chambers 157A, 157B, and 157C. It can be seen that the side of the housing 152 that contains the pressurized set 157A has lengthened, thereby causing the housing 152 to bend. As briefly mentioned above, an increase in pressure within the set 156A will induce an increase in the amount of deformation of the shaft 158.

Figure 5:
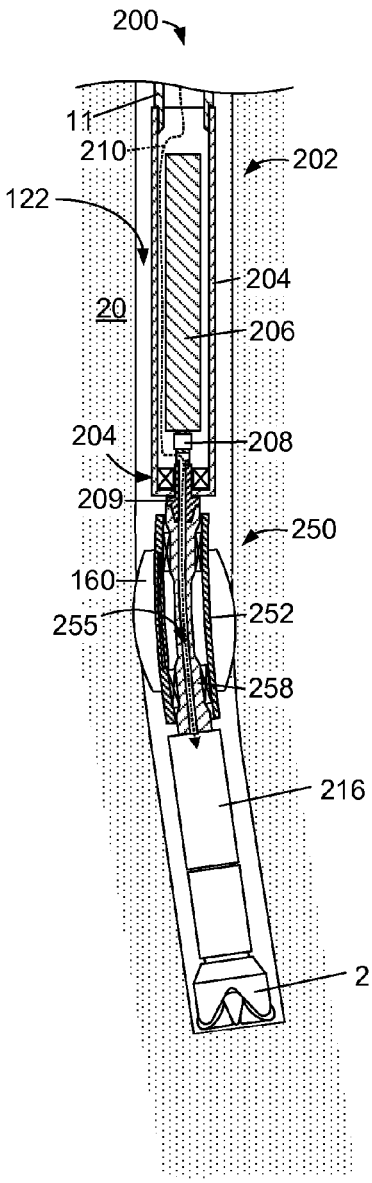
FIGS. 5-7 are additional embodiments of a drill string with a steering sub according to certain aspects of the present disclosure.
Figure 6:
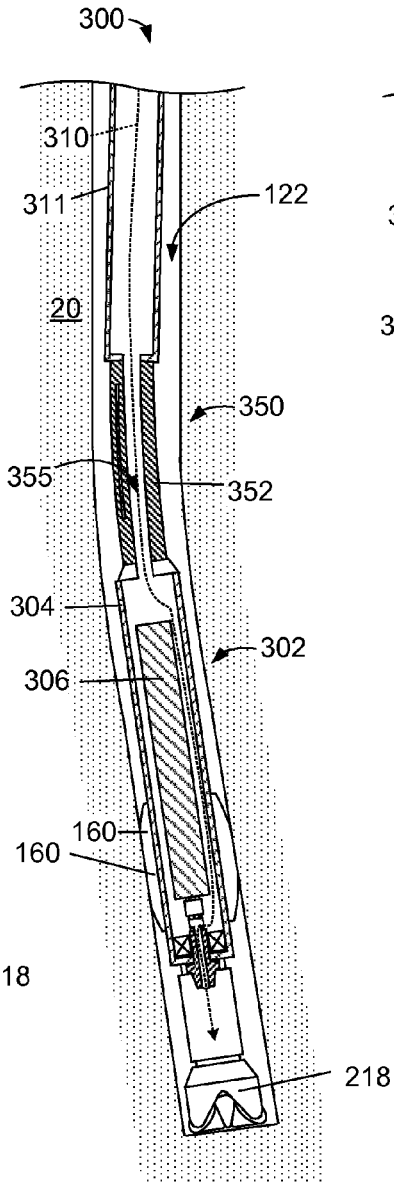
Figure 7:
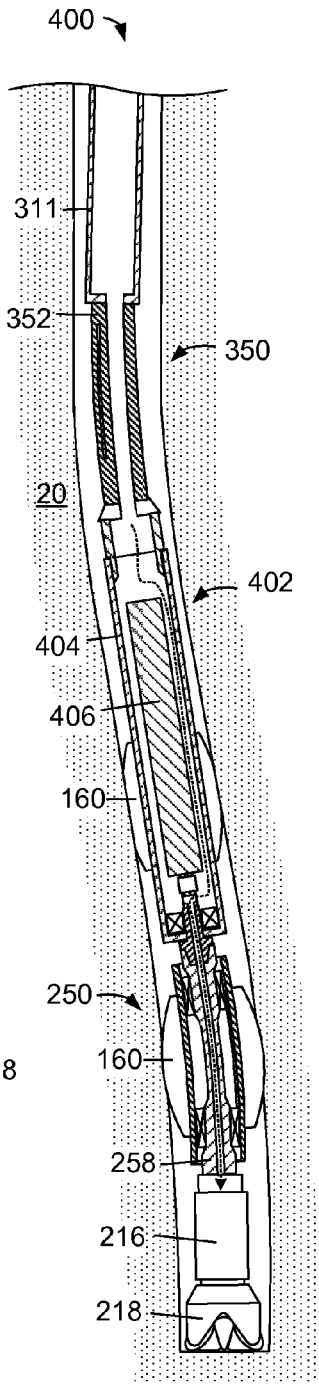

Referring now to FIGS. 5-7, with continued reference to FIGS. 3A-3C, illustrated are additional exemplary embodiments of a drill string with a steering sub according to certain aspects of the present disclosure. FIG. 5 depicts a steerable drilling string 200 wherein a top end of the shaft 258 of the steering sub 250 may be coupled to the lower end of a rotor 206 of a mud motor 202 such that the shaft 258 rotates with the rotor 206. The mud motor 202 includes a bearing assembly 204 at the lower end and a flex coupling 208 coupled between the rotor 206 and the output shaft 209. The lower end of the shaft 258 may be coupled to the housing of the lower sub 216 such that the entire lower sub 206 rotates synchronously with the shaft 258 and the drill bit 18 is fixedly coupled to the lower sub 216. In this embodiment, the shaft 258 rotates in the deformed or bent shape created by the pressure of the fluid within one or more of the pressure chambers 256. In certain embodiments, the shaft 258 may comprise a plurality of connected elements (not shown in FIG. 5) that efficiently transmit torque while rotating with respect to each other about axes that are generally perpendicular to the axis 30 so as to maintain the curved shape shown in FIG. 5 without elastically deforming the individual elements. The steering sub 250 includes a mud flow passage 255 to allow the mud flow 210 to reach the drill bit 218 after passing through the mud motor 202. The housing 252 of the steering sub 250 may be prevented from rotating within the borehole by the engagement of the stabilizers 160 with the sides of the borehole 122. It can be seen that, in this example, the diameter of the borehole 122 is substantially constant through both the vertical and angled sections visible in FIG. 5.

FIG. 6 depicts an example embodiment of a steerable drilling string 300 having a mud motor 302 located below an adjustable bend 350. The housing 352 of the adjustable bend 350 is fixedly coupled at a top end to the lower end of string of drill pipe 311 and at a bottom end to the stator 304 of the mud motor 302. The shaft 306 of the mud motor 302 is coupled to the drill bit 18. The adjustable bend 350 does not include a shaft and the housing flexes between the undeformed and deformed shapes, as generally described above, to steer the drill bit 218. A mud flow passage 355 passes through the housing 350 to provide the mud flow to the mod motor 302. In certain embodiments, the string of drill pipe 311 may be displaced within the borehole 122, as shown in FIG. 6, to accommodate the deformed or bent shape of the housing 352. In certain embodiments, the stabilizers 160 may be attached at a lower end of the mud motor 302, as shown in FIG. 6 but may be attached at other points along the mud motor 302 or the lower end of the string of drill pipe 311, without departing from the scope of the disclosure.

FIG. 7 depicts another embodiment of a steerable drilling string 400 with a mud motor 402 located below an adjustable bend 350 and a steering sub 250 located below the mud motor 402. The housing 352 of the adjustable bend 350 is fixedly coupled to the lower end of the string of drill pipe 411 and to the stator 404 of the mud motor 402. The rotor 406 of the mud motor 402 is coupled through shaft 258 of the steering sub 250 to the drill bit 218. In certain embodiments, the stabilizers 160 are attached at a lower end of the mud motor 402 and to the housing 258 of the steering sub 250. In certain embodiments, stabilizers 160 may be attached at different points along one or both of the mud motor 402 and the steering sub 450. In certain embodiments, stabilizers 160 may be attached to only one of the mud motor 402 and the steering sub 450.

The above disclosure has shown example systems and methods for steering a drill string to advance in a lateral direction using a steering sub that positions the drill bit at a selected angle and in a selected direction. The steering sub includes a deformable element that may be stationary, relative to the borehole, or provide a portion of the rotating coupling between the rotor of a mud motor and a drill bit. The disclosed system may allow for faster drilling, as the diameter of the vertical borehole may be smaller than the diameter required for a conventional directional drill string, and may provide improved control over the angle and direction of the lateral component of the drill path.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A wellbore drilling apparatus, comprising:
- a housing defining a central passage;
- a shaft extended within the central passage;
- bearings arranged within the central passage and configured to receive and support the shaft for rotation within the central passage; and
- one or more pressure chambers defined longitudinally within the housing, each pressure chamber comprising an elongate tubular conduit extending longitudinally along a length of the housing, wherein each pressure chamber bends in response to experiencing an increased fluid pressure and thereby exerts a longitudinal bending force on the housing without needing to contact the surrounding wellbore, and wherein the longitudinal bending force causes the shaft to correspondingly bend via engagement with the bearings.

2. The apparatus of claim 1, wherein bending the housing causes the bearings to apply lateral forces to the shaft.

3. The apparatus of claim 1, further comprising one or more stabilizers coupled to an exterior of the housing and configured to contact a portion of a borehole and resist rotation of the housing relative to the borehole.

4. The apparatus of claim 1, wherein the one or more pressure chambers comprise:
- a first set of pressure chambers defined longitudinally in the housing;
- a second set of pressure chambers defined longitudinally in the housing and circumferentially offset from the first set of pressure chambers; and
- a third set of pressure chambers defined longitudinally in the housing and circumferentially offset from the second set of pressure chambers.

5. The apparatus of claim 4, wherein the first, second, and third sets of pressure chambers are equidistantly spaced from each other.

6. The apparatus of claim 4, wherein one or more of the first, second, and third sets of pressure chambers are configured to be pressurized simultaneously in order to bend the shaft in a plurality of lateral directions.

7. The apparatus of claim 6, wherein the first, second, and third sets of pressure chambers are able to be pressurized to different degrees of pressurization in order to bend the shaft in the plurality of lateral directions.

8. The apparatus of claim 1, wherein the housing is configured to be coupled to a drill pipe.

9. A wellborne drilling system, comprising:
- a drill string;
- a drill bit arranged at a distal end of the drill string; and
- a steering apparatus coupled between the drill string and the drill bit and configured to direct the drill bit, the steering apparatus comprising:
  - a housing defining a central passage;
  - a shaft extended within the central passage;
  - bearings arranged within the central passage and configured to receive and support the shaft for rotation within the central passage; and
  - one or more pressure chambers defined longitudinally within the housing, each pressure chamber comprising an elongate tubular conduit extending longitudinally along a length of the housing, wherein each pressure chamber bends in response to experiencing an increased fluid pressure and thereby exerts a longitudinal bending force on the housing without needing to contact the surrounding wellbore, and wherein the longitudinal bending force causes the shaft to correspondingly bend via engagement with the bearings.

10. The system of claim 9, further comprising a mud motor arranged on the drill string and having a stator coupled to both the drill string and the housing of the steering apparatus, the mud motor further having a rotor operatively coupled to the shaft of the steering apparatus such that rotation of the rotor rotates the shaft.

11. The system of claim 10, further comprising one or more stabilizers coupled to an exterior of the housing and configured to contact a portion of a borehole and resist rotation of the housing relative to the borehole.

12. The system of claim 9, further comprising a mud motor arranged on the drill string and having a stator coupled to the shaft of the steering apparatus and a rotor operatively coupled to the drill bit such that rotation of the rotor rotates the shaft.

13. The system of claim 12, further comprising one or more stabilizers arranged about the mud motor and configured to contact a portion of a borehole and resist rotation of the stator relative to the borehole.

14. The system of claim 9, wherein the one or more pressure chambers comprise:
- a first set of pressure chambers defined longitudinally in the housing;
- a second set of pressure chambers defined longitudinally in the housing and circumferentially offset from the first set of pressure chambers; and
- a third set of pressure chambers defined longitudinally in the housing and circumferentially offset from the second set of pressure chambers.

15. The system of claim 14, wherein the first, second, and third sets of pressure chambers are equidistantly spaced from each other.

16. The system of claim 14, wherein one or more of the first, second, and third sets of pressure chambers are configured to be pressurized simultaneously in order to bend the shaft in a plurality of lateral directions.

17. The system of claim 16, wherein the first, second, and third sets of pressure chambers are able to be pressurized to different degrees of pressurization in order to bend the shaft in the plurality of lateral directions.

18. A method of steering a drill bit in a wellbore, the method comprising:

supporting a shaft for rotation within a housing of a steering sub with one or more bearings arranged within the housing and radially interposing the shaft and the housing, the shaft being operatively coupled to the drill bit;

increasing a fluid pressure within one or more pressure chambers defined within the housing, each pressure chamber comprising an elongate tubular conduit extending longitudinally along a length of the housing;

bending the one or more pressure chambers in response to the fluid pressure increase and thereby exerting a longitudinal bending force on the housing with the one or more pressure chambers without needing to contact the surrounding wellbore;

bending the housing in response to the longitudinal bending force exerted by the one or more pressure chambers; and bending the shaft via engagement with the one or more bearings which transfer lateral deflection forces from the housing to the shaft.

19. The method of claim 18, wherein increasing a fluid pressure within the one or more pressure chambers comprises conveying a hydraulic fluid to the one or more pressure chambers with at least one control line communicably coupled thereto.

20. The method of claim 18, wherein the one or more pressure chambers comprise:

a first set of pressure chambers defined longitudinally in the housing;

a second set of pressure chambers defined longitudinally in the housing and circumferentially offset from the first set of pressure chambers; and a third set of pressure chambers defined longitudinally in the housing and circumferentially offset from the second set of pressure chambers.

21. The method of claim 20, further comprising:

increasing a fluid pressure within one or more of the first, second, and third sets of pressure chambers simultaneously and thereby causing the housing to bend in a plurality of lateral directions; and bending the shaft in the plurality of lateral directions via engagement with the one or more bearings.

22. The method of claim 20, further comprising:

increasing a fluid pressure within the first, second, and third sets of pressure chambers to different degrees of pressurization and thereby causing the housing to bend in a plurality of lateral directions; and bending the shaft in the plurality of lateral directions via engagement with the one or more bearings.

23. An adjustable bend sub for drilling a wellbore, comprising:

a housing having first and second ends configured to be fixedly coupled to first and second elements, respectively, of a drill string; and one or more pressure chambers defined longitudinally in the housing, each pressure chamber comprising an elongate tubular conduit extending longitudinally along a length of the housing, wherein each pressure chamber bends upon experiencing an increased fluid pressure and thereby exerts a longitudinal bending force on the housing without needing to contact the surrounding wellbore.

24. The adjustable bend sub of claim 23, further comprising a mud flow passage through the housing.

* * * * *